US006895991B2

(12) United States Patent
Woessner

(10) Patent No.: US 6,895,991 B2
(45) Date of Patent: May 24, 2005

(54) MISSILE THRUST SYSTEM AND VALVE WITH REFRACTORY PISTON CYLINDER

(75) Inventor: George T. Woessner, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 250 days.

(21) Appl. No.: 10/216,622

(22) Filed: Aug. 9, 2002

(65) Prior Publication Data

US 2004/0025939 A1 Feb. 12, 2004

(51) Int. Cl.[7] ..... F02K 9/56

(52) U.S. Cl. ..... 137/375; 251/368; 60/254; 420/433; 148/407

(58) Field of Search ..... 251/368; 137/375; 60/253, 254, 255; 420/433; 148/407, 442

(56) References Cited

U.S. PATENT DOCUMENTS

| | | | | | |
|---|---|---|---|---|---|
| 3,022,041 | A | | 2/1962 | Tulp | 251/324 |
| 3,853,146 | A | | 12/1974 | Blair | 137/625.3 |
| 4,337,797 | A | | 7/1982 | Caruso | 137/625.48 |
| 4,428,194 | A | | 1/1984 | Stokes et al. | 60/39.02 |
| 4,442,669 | A | | 4/1984 | Burkes, Jr. et al. | 60/251 |
| 4,445,532 | A | | 5/1984 | Mitchell | 137/495 |
| 4,458,718 | A | | 7/1984 | Vick | 137/505 |
| 4,528,978 | A | * | 7/1985 | Robinson | 126/677 |
| 4,553,474 | A | | 11/1985 | Wong et al. | 98/1.5 |
| 4,574,586 | A | * | 3/1986 | Gabrysch | 60/254 |
| 4,768,555 | A | | 9/1988 | Abel | 137/627.5 |
| 4,779,821 | A | | 10/1988 | Sutton | 244/52 |
| 4,785,839 | A | | 11/1988 | Cleasby | 137/1 |
| 4,964,422 | A | | 10/1990 | Ball et al. | 137/512.1 |
| 4,964,431 | A | | 10/1990 | Ball et al. | 137/1 |
| 4,967,778 | A | | 11/1990 | Ball et al. | 137/1 |
| 5,000,213 | A | | 3/1991 | Tervo et al. | 137/1 |
| 5,005,804 | A | | 4/1991 | Andersen et al. | 251/215 |
| 5,029,599 | A | | 7/1991 | Ball | 137/1 |
| 5,067,506 | A | | 11/1991 | Ball et al. | 137/1 |
| 5,102,097 | A | | 4/1992 | Davis et al. | 251/283 |
| 5,113,910 | A | | 5/1992 | Ball | 137/630.15 |
| 5,334,090 | A | | 8/1994 | Rix | 454/72 |
| 5,351,934 | A | | 10/1994 | Jensen et al. | 251/65 |
| 5,386,848 | A | | 2/1995 | Gilchrist et al. | 137/510 |
| 5,520,578 | A | | 5/1996 | Bloch et al. | 454/74 |
| 5,590,852 | A | | 1/1997 | Olson | 244/118.5 |
| 5,899,064 | A | | 5/1999 | Cheung | 60/406 |
| 5,927,335 | A | | 7/1999 | Christensen | 137/821 |
| 6,006,780 | A | | 12/1999 | Tseng et al. | 137/488 |
| 6,065,284 | A | * | 5/2000 | Horner et al. | 60/203.1 |
| 6,202,674 | B1 | | 3/2001 | Wingett | 137/343 |
| 6,227,247 | B1 | | 5/2001 | Abel | 137/625.62 |
| 6,233,919 | B1 | | 5/2001 | Abel et al. | 60/204 |
| 6,276,125 | B1 | | 8/2001 | Tseng | 60/229 |
| 6,308,723 | B1 | | 10/2001 | Louis et al. | 137/1 |

* cited by examiner

*Primary Examiner*—A. Michael Chambers
(74) *Attorney, Agent, or Firm*—Ingrassia Fisher & Lorenz

(57) ABSTRACT

An improved pneumatic valve and a missile with an improved thrust directional valve. In one embodiment, a refractory material lining for a pneumatic valve enables better valve operation and better valve performance. A thin-wall cylindrical sleeve of rhenium or other suitable refractory metal is located inside a cylinder. A valve piston may then travel within the refractory sleeve with greater reliability and better operation. The refractory sleeve cylinder lining can be subject to high temperatures at a rapid rate and remain operational. Under such a hostile environmental, including corrosive/erosive environments created by the passage of hot propellant gasses, the refractory cylinder sleeve has a more reliable operational life and is lighter in weight than conventional valves made entirely of refractory metals.

10 Claims, 4 Drawing Sheets

MISSILE THRUST SYSTEM AND VALVE WITH REFRACTORY PISTON CYLINDER

CROSS-REFERENCES TO RELATED APPLICATIONS

No priority is claimed from any other patent application.

This application is related to a contemporaneously-filed patent for Vehicle and Lightweight Pneumatic Pilot Valve Therefor, Ser. No. 10/234,697 Honeywell International Incorporated, which is incorporated herein by reference.

This patent application is related to U.S. patent application Ser. No. 10/138,090 filed May 3, 2002 entitled Oxidation and Wear Resistant Rhenium Metal Matrix Composite; U.S. patent application Ser. No. 10/138,087 filed May 3, 2002 entitled Oxidation Resistant Rhenium Alloys; U.S. Provisional Patent Application Ser. No. 60/384,631 filed May 31, 2002 entitled Use of Powdered Metal Sintering/Diffusion Bonding to Enable Applying Silicon Carbide or Rhenium Alloys to Face Seal Rotors; and U.S. Provisional Patent Application Ser. No. 60/384,737 filed May 31, 2002 entitled Reduced Temperature and Pressure Powder Metallurgy Process for Consolidating Rhenium Alloys, which are all incorporated herein by reference.

STATEMENT AS TO RIGHTS TO INVENTIONS MADE UNDER FEDERALLY-SPONSORED RESEARCH AND DEVELOPMENT

The U.S. Government may have certain rights in this invention, which was developed under contract no. F08630-99-C-0027 awarded by the Airforce Research Lab/AFRL.

BACKGROUND OF THE INVENTION

1. Field of the Invention

This invention relates to pneumatic valves, and more particularly to lightweight pneumatic valves capable of withstanding the hostile environment generated from solid propellant or other propellants, such as those used in rocket or missile applications.

2. Description of the Related Art

When a missile or other projectile is launched, it is sometimes desired that it steer itself, or provide for its own guidance. A projectile's ability to guide itself can be accomplished by the redirection of the projectile's propellant output, especially for missiles. While valves are sometimes used to redirect propellant thrust, they are subject to certain drawbacks under certain circumstances.

Pneumatic valves for missile applications should be lightweight yet capable of withstanding the environment and effects of hot gasses produced from the missile's engine, which may be a solid rocket type motor, which is also known as a gas generator. A gas generator can generate a gas at temperatures of up to five thousand degrees Fahrenheit (5000° F.). Some valves need not necessarily be capable of withstanding these temperature environments for long periods of time, as the valves may only be required to handle hot gas for short duty cycles.

High temperature divert and attitude control valves for missiles, spacecraft, and other craft may use poppet and piston ring valve elements to function. These attitude control valves have low friction and wear-resistant sliding surfaces in order to function properly for extended periods of time. Linkage and wear problems can exist with high temperature composite valve structures. These problems may relate to material porosity, erosive effects of propellant gasses, and the rapid wear of sliding and contact surfaces of pistons, cylinders, and rings. For these reasons, refractory metals have been used in missile applications.

Feasibility limitations exist with the use of refractory metal valves due to material and manufacturing process restrictions, the high weight density of such materials, and the high unit cost of such materials. It is challenging to develop other coatings and processes for other lighter materials that are capable of withstanding transient thermal expansion effects due to the dramatic change in temperature (ambient temperature to propellant gas temperature).

In addition to the difficulties posed by valves, solid fuel missiles in general with diameters of less than roughly 30 inches have had to depend upon fins to guide the missile. Larger missiles and rockets have used thrust diversion valves in place of fins for guidance. However, conventional thrust valves are of the size and weight that would make them impractical to use for guidance in place of fins on such smaller vehicles having solid fuel and associated high temperature operating environments. This is especially so in the area of solid fueled tactical missiles, which may have a diameter of 10 inches or less.

SUMMARY OF THE INVENTION

In view of the foregoing disadvantages, the present invention provides new missile and valve construction that withstands the intense heat and hostile environment present with the diversion of propellant thrust gas and the like. In particular, missiles and other thrust-propelled craft with the new valve can be better and more predictably directed and controlled.

A refractory metal piston cylinder is used in the valve. The development of a preferred embodiment of the valve with a refractory metal piston cylinder as set forth herein has proven to be a key component in successful demonstration tests under high temperatures, up to five thousand degrees Fahrenheit (5000° F.). With the development of the preferred refractory metal piston cylinder, certain other favorable characteristics, structures, and elements have also been established. As set forth in more detail below, the present invention includes the concept of integrating a refractory metal piston cylinder into an ablative composite structure in order to produce a lightweight pneumatic control valve for missiles, spacecraft, undersea vehicles, torpedoes, weapons systems, auto-safety devices, or any other applications related to the use of solid propellant gas generator control valves.

In one embodiment, the valve may have a shrink-fit or interference fit refractory cylinder lining. In particular, a thin wall cylindrical sleeve of a refractory metal such as rhenium or otherwise is fit by interference or bonded into generally insulating and durable material such as carbon fiber reinforced carbon-carbon composite or fiber reinforced ablative phenolic in order to provide a sufficiently leak-tight piston cylinder in a lightweight structural composite. In taking this approach, the fabrication of a lightweight composite hot gas valve with poppet cylinders is enabled that is impervious or at least resistant to piston ring-wear and other erosive effects of solid propellant gasses. These valves are useful on tactical missile systems that require limited exposure to hot gasses up to temperatures of five thousand degrees Fahrenheit (5000° F.).

The refractory metal sleeve is lightweight, and it can be manufactured economically, as opposed to fabricating the entire cylinder out of a refractory metal. The fiber-reinforced composite provides a lightweight structure which has high strength characteristics at low cost. In one embodiment, the piston cylinder preferably is shrink-fit into the composite structure and attached to a solid propellant hot gas generator.

The generator is ignited to produce a high-mass flow of hot propellant gasses, which are then diverted using a pneumatically-driven piston which reciprocates in the refractory metal sleeve. When subject to the hot propellant gasses, the sleeve temperature increases rapidly and expands diametrically into the composite housing to create a generally leak-tight seal.

By way of example only, one embodiment of the invention is related to a thrust valve system for solid fuel missile guidance that is enclosed in the missile's housing, which is less than 30 inches in diameter. The missile thus would not need fins as its primary steering mechanism. In more detailed aspects of the invention, the missile could have a diameter less than 10 inches or even less than 7 inches, to provide for air launches by aircraft or to fit in other small launching systems on space, air, ground or sea vehicles. In one preferred embodiment, six thrust valves are used and located within the body of the missile adjacent to its main propellant exhaust port.

Other features and advantages of the present invention will become apparent from the following description of the preferred embodiments, taken in conjunction with the accompanying drawings, which illustrate, by way of example, the principles of the invention.

DESCRIPTION OF THE PREFERRED EMBODIMENT(S)

The detailed description set forth below in connection with the appended drawings is intended as a description of presently-preferred embodiments of the invention and does not represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figures 1, 2:
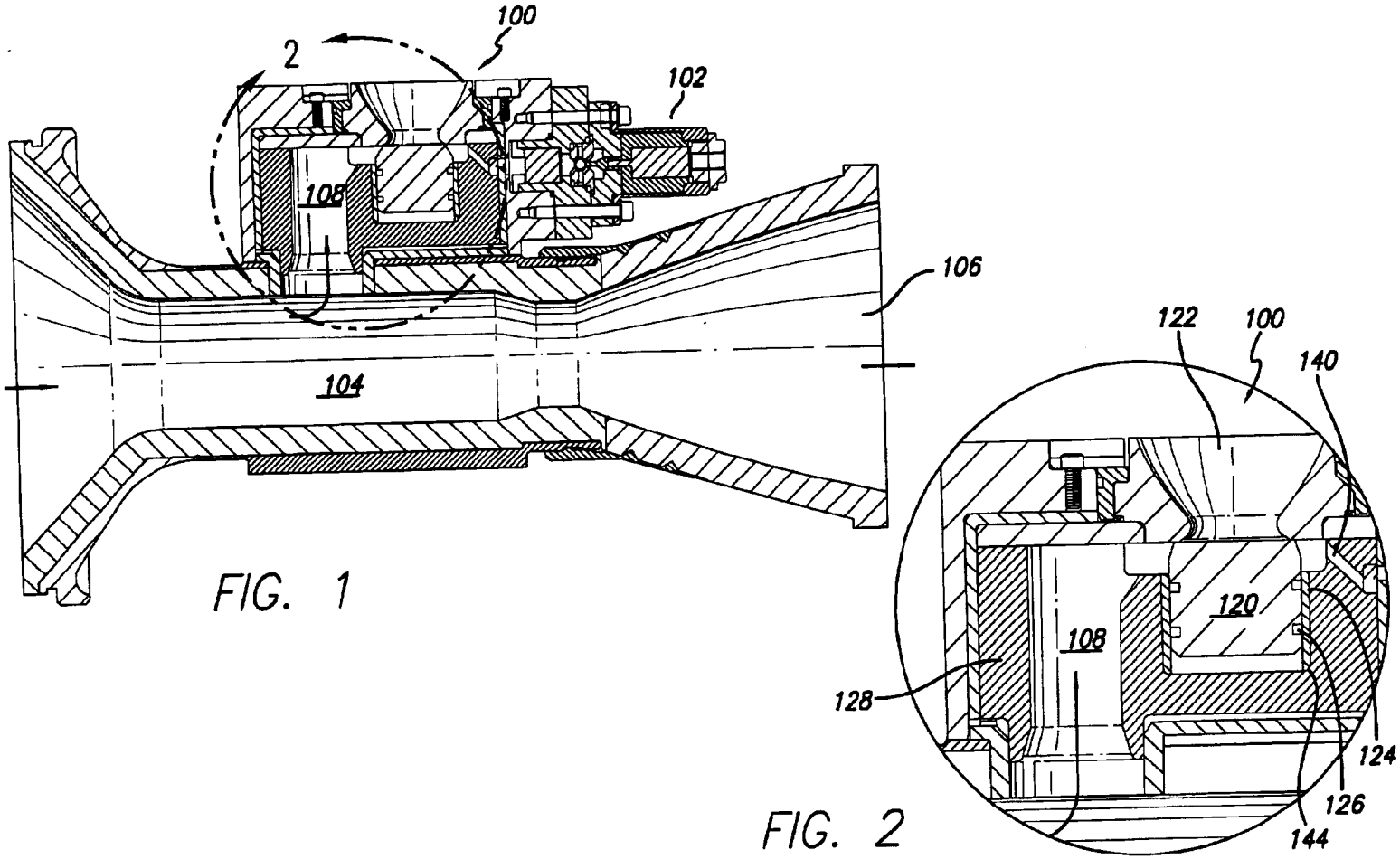
FIG. 1 is a front half-section view of the piston cylinder from the present invention with accompanying pilot valve, and duct work for the transmission of hot propellant gasses to the valve.
FIG. 2 is a close-up half-section view of the valve shown in FIG. 1.

FIG. 1 shows in general schematic view the basic elements used in the gas valve with its refractory piston cylinder of the present invention. The valve 100 is coupled to a pilot valve 102 which generally controls the operation of the valve 100. In FIG. 1, hot gas is shown as flowing in from the left, passing through the throat 104 and exiting the rear nozzle 106. The hot gas can have a temperature of up to 5000° F., especially if generated by a solid rocket fuel.

As the hot propellant gases pass through the throat 104, some of the gasses flow into the valve inlet 108 where they may either pass through the valve 100 or are restrained by the valve 100 according to the operation of the valve 100 in conjunction with the pilot valve 102. When the valve 100 is opened, hot propellant gas may flow out the valve 100 as the throat 104 serves to exert back pressure on the in-flowing hot propellant gasses causing them to seek out as many available exit routes as possible, including open valves 100.

FIG. 2 shows in more detail the valve 100 shown in FIG. 1. A main portion of the valve is the poppet 120 which serves to control the flow of hot propellant gasses from the inlet 108 to the valve nozzle 122. In so doing, the poppet 120 is subject to the extreme conditions generated by the hot propellant gasses. These include rapid increases in temperature and high operating temperatures, as well as erosive and/or corrosive effects of the hot propellant gas. The poppet 120 may be refractory, carbon-carbon, or other materials capable of withstanding the environment created by the passage of hot propellant gasses.

In operation, the poppet 120 generally oscillates rapidly in order to provide lateral thrust to the craft incorporating the nozzle 122. This lateral thrust can effect changes in pitch, roll and yaw, depending upon the operation and positioning of the valve 100.

When operated, the poppet 120 of the valve 100 oscillates rapidly in order to provide short bursts of thrust for better control of the associated craft. This rapid oscillation of the poppet 120 creates the opportunity for greater friction and breakdown due to the overall length of travel the poppet 120 will take inside the cylinder sleeve 124. Additionally, the cylinder sleeve 124 is also subject to friction due to graphite or other piston rings (not shown) which are seated in piston ring grooves 126.

The refractory metal cylinder sleeve 124 is encased in highly durable and propellant gas resistant materials such as carbon fiber reinforced carbon-carbon composite, fiber reinforced ablative phenolic composite, or otherwise. The housing material 128 not only provides support for the cylinder sleeve 124 by surrounding it, but also forms the passageways and duct work for both the valve inlet 108 and the pilot valve supply 140 that enables the pilot valve 102 to control the operation of the poppet 120 and the valve as a whole 100.

In combination with the high operating temperatures, the corrosive/erosive environment, as well as the friction generated by the oscillation of the poppet 120, the cylinder sleeve 124 becomes an important component of the valve 100 as its integrity can determine the useful life and reliable operation of the valve 100. Under some circumstances, less reliable and less durable cylinders and/or cylinder sleeves may fail and either allow leakage of the hot propellant gas past the poppet 120, suffer burning, scorching or the like, or otherwise fail and disable, hinder, or interfere with the proper operation of the poppet 120 and/or the valve 100. Failure of the valve can lead to failure of the vehicle, craft, or missile.

The use of refractory metals, such as rhenium, have solved the problem of cylinder integrity necessary to the proper operation of the poppet 120 of the valve 100. Such refractory cylinder sleeves are generally leak-tight due to thermal expansion experienced during the injection of hot propellant gasses. Such refractory sleeves provide generally leak-tight operation with little or no leakage between the sleeve 124 and the housing 128 as well as the sleeve 124 and the poppet 120 and/or piston rings. Other refractory materials that could be used include rhenium alloys as well as tungsten, molybdenum, tantalum, niobium, and/or alloys of these or other refractory metals or substances now known or later developed.

In constructing the valve 100, a valve housing 128 is machined or molded from sufficiently durable and reliable materials such as carbon fiber, reinforced carbon-carbon composite or fiber reinforced ablative phenolic composite.

The valve housing 128 is machined to provide a cylindrical bore 144 that is constructed to accept a generally thin wall and cylindrical refractory sleeve 124. The thin sleeve 124 provides a reduced or low-friction contact surface with sufficient hardness, strength, and wear characteristics for a reciprocating piston 120 and piston ring set which serves as a poppet 120 to divert hot gasses of a solid propellant gas generator.

The housing bore 144 has an inside diameter, which is machined in conjunction with the outside diameter of the cylinder sleeve 124. The diameters are machined to be close-toleranced to assure adequate structural margin during worst case differentials of thermal expansion between the housing bore 144 and the cylinder sleeve 124. The interfaces of the housing bore 144, cylindrical sleeve 124, and piston 120 including interfacing featuring sizes, fits, and tolerances, may be determined analytically from transient thermal and structural analyses. In order to provide for a better or optimum performance, care is taken to thoroughly evaluate sleeve buckling and compressive stress margins for each application to which the present invention is put.

The outside diameter of the cylindrical sleeve 124 is ground to a close-toleranced dimension and fitted into the housing bore 144 inside diameter using an interference fit. Typically, this is a thermal shrink-fit between the housing 128 at the bore 144 and the cylindrical sleeve 124. The sleeve 124 may also be clearance-fit and bonded in the housing bore 144 with a high temperature ablative adhesive for duty cycles of short duration.

The sleeve 124 may be machined using wire EDM (electro-discharge machining) or other conventional or known processes and then ground to specification. The outside surface finish of the sleeve 124 may be roughened to assure fixity with the housing bore 144. An eight micro-inch (0.000008 inch) or less finish may be ground or honed on the inside diameter of the sleeve 124 after it is installed in the composite housing bore 144. The inside diameter of the sleeve 124 is sized to provide a clearance with the cylindrical piston poppet 120 that reciprocates in the sleeve 124. Hot propellant gasses are ported via the composite valve body 128 in a manner to assure that pressure forces retain the sleeve 124 else a retaining device may be added to prevent the sleeve 124 from extruding or displacing during operation.

Figure 3:
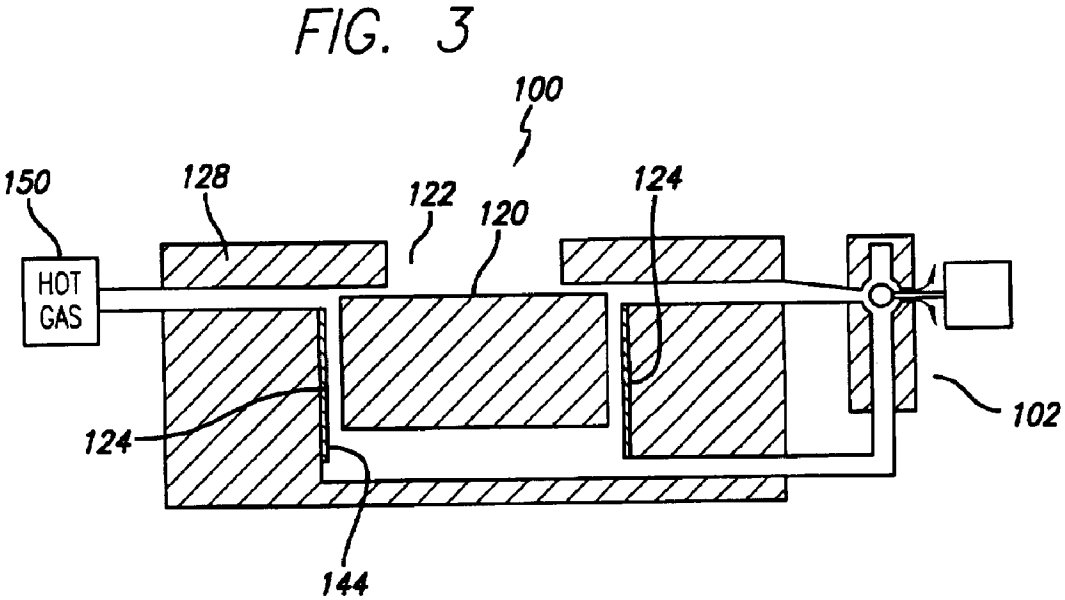
FIG. 3 is a schematic diagram of the valve of the present invention.

FIG. 3 shows a schematic view of the valve 100. With hot gas 150 traveling into the housing 128 according to the control of a hot gas pilot valve 102 and cold gas pilot valve 152. The operation of the pilot valves 102, 152 controls the attitude of the poppet or piston 120 in the cylindrical bore 144.

The hot gas pilot valve 102 controls the pressure behind the piston 120. When this pressure is increased, the piston moves up to close off the valve 100 and to prevent thrust from exiting the valve 100. When this pressure is reduced, as by venting to ambient, the surrounding pressure of the hot gas 150 pushes the piston 120 into the cylinder and cylinder sleeve 124.

As set forth in the related application regarding the Lightweight Pneumatic Valve, above, the operation of pilot valve 102 can be consolidated so that the hot gas thrust 150 can be redirected below the piston 120 by a single pilot valve 102. When the pilot valve 102 oscillates or alternates its state (closed to open or vice versa), the piston correspondingly operates within the confines of the cylinder sleeve 124.

Figure 5:
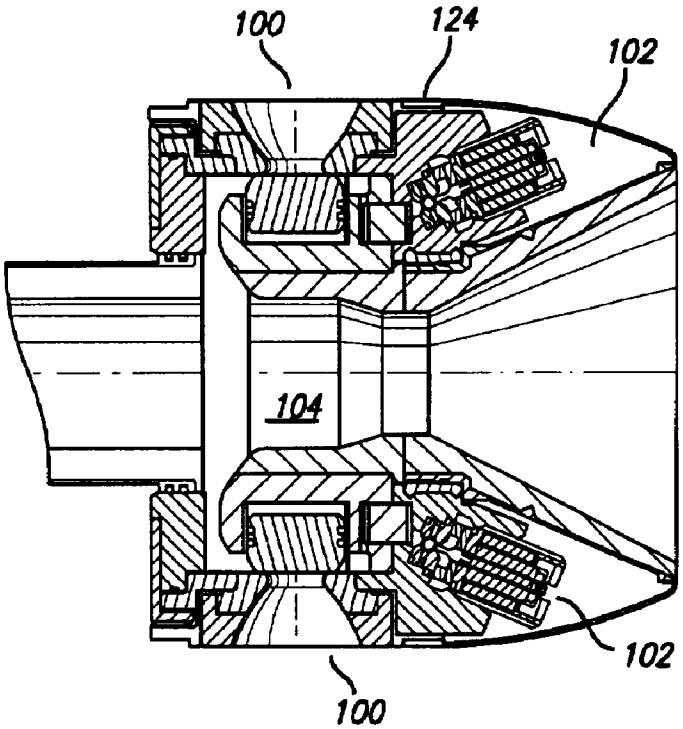
FIG. 5 is a side cross-sectional view of FIG. 4 taken along Line 5—5 additionally showing accompanying pilot valves.
Figure 4:
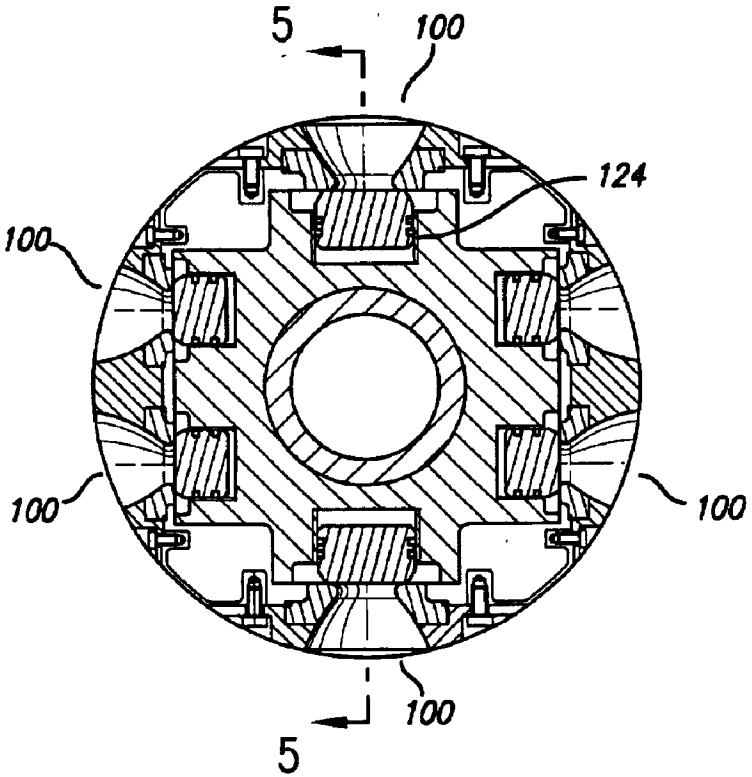
FIG. 4 shows an axial cross-section of a valve geometry enabling the control of pitch, yaw, and roll for a projectile incorporating such geometry.

FIGS. 4 and 5 show cross-sectional views of one embodiment of nozzle configurations used to control the pitch, roll, and yaw of a craft, such as a missile or other projectile, incorporating the refractory cylinder sleeves of the present invention. FIG. 4 shows a set of six (6) radially-disposed valves 100 with the top and bottom valves generally controlling the pitch while the two pairs of oppositely-opposed side valves controlling yaw and roll according to their operation (separate or tandem) upon the craft's center of gravity. FIG. 5 shows a cross-section of a craft possibly having the valve configuration of FIG. 4 with the top and bottom valves 100 shown relative to the throat 104 and in conjunction with the pilot valves 102.

Figure 6:
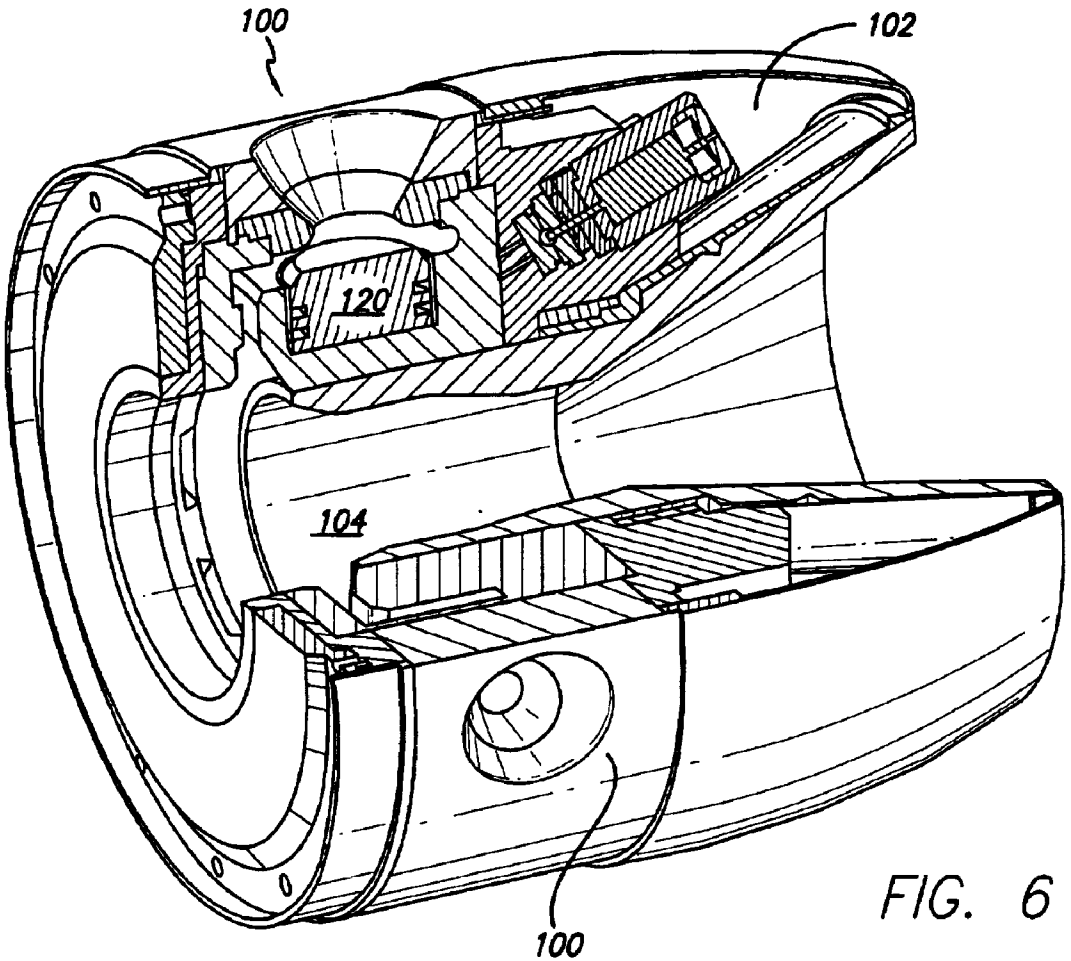
FIG. 6 is a front quarter cross-sectional view of a rear section of a missile incorporating the valves of the present invention using a geometry similar to that shown in FIG. 4.

In one embodiment, the quarter section real nozzle section of a craft as shown in FIG. 6 where the gas inlet 160 is generally annular or ring-like in nature in order to generally supply all valves with equal gas pressure from the burning source of solid or other propellant.

Other embodiments include the use of other materials and other geometries of valve designs that incorporate the use of refractory or other resilient materials according to the present invention.

Figure 7:
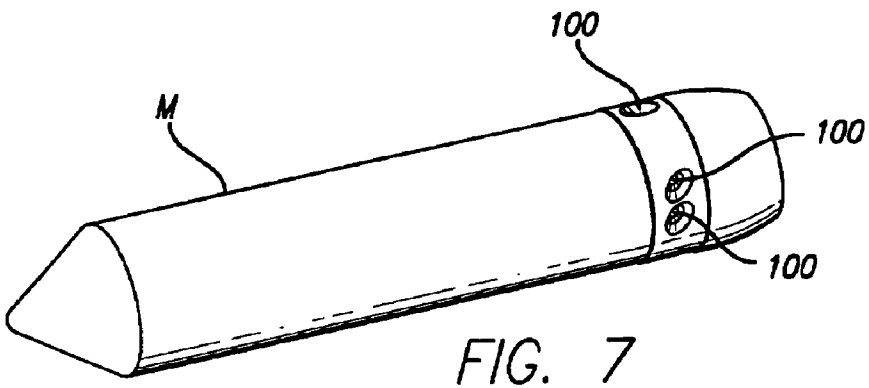
FIG. 7 is a side perspective view of a missile incorporating the valve system of the present invention.

The present valve can have one or more advantages over prior valve cylinder structures, the greatest of which is more reliable operation in critical applications where such reliability is crucial for the proper operation and guidance of crafts such as missiles such as the missile M of FIG. 7. As is known in the art, such valves as set forth here in the present invention that is disclosed herein may be operated in conjunction with self-guided or remote telemetry signals. However, without the reliable and predictable operation of such guidance valves in an environment that is by necessity hostile to the valve itself, the accuracy of a craft incorporating such lesser valves which may diminish the utility and capability of the missile, and make the delivery of the payload of such a missile more random and less accurate.

With the greater accuracy delivered by the valves described herein, missile craft and the like deliver their payloads with greater accuracy, reliability, and predictability which may diminish the need for using such missiles for repeated strikes. If, for example, the missile is used against a military target to deliver a weapons system, such as an explosive of minor or major explosive capacity, the ability to deliver such a payload with greater accuracy enables diminished collateral damage (including civilian casualties) as well as inflicting greater damage to military targets. It may also give an adversary greater pause as the resources incorporating the valve of the present invention can be husbanded and used to greater effect. For example, while it may currently require four or five missiles to destroy a bridge across a significant river, the accuracy of a missile incorporating the valve of the present invention with its refractory sleeve lining may enable as few as one or two missiles to take out the bridge so that the remaining missiles can be used for other targets. Consequently, an adversary may think twice before antagonizing the holder of such technology as there may be other, better, more useful, and more constructive ways to resolve conflict than to force the opponent to resort to military action.

Alternatively, civilian use of the present missile valve could include delivering payloads into orbit or otherwise. With the greater reliability of the valve 100 and associated missile, costs (including insurance) may be reduced.

While the present invention has been described with reference to a preferred embodiment or to particular embodiments, it will be understood that various changes and additional variations may be made and equivalents may be substituted for elements thereof without departing from the scope of the invention or the inventive concept thereof. In addition, many modifications may be made to adapt a particular situation or material to the teachings of the invention without departing from the essential scope thereof. Therefore, it is intended that the invention not be limited to particular embodiments disclosed herein for carrying it out, but that the invention includes all embodiments falling within the scope of the appended claims.

What is claimed is:

1. A valve for directing propellant thrust, comprising:

a refractory cylinder wall lining defining a cylinder symmetrically disposed about a longitudinal axis; and a piston disposed axially relative to the longitudinal axis and configured to slidably move within the cylinder along the longitudinal axis.

2. A valve for directing propellant thrust as set forth in claim 1, wherein the refractory cylinder wall lining is made from metal of the group consisting of rhenium, tungsten, niobium, tantalum, molybdenum, and alloys thereof.

3. A valve for directing propellant thrust as set forth in claim 1, further comprising:

a housing defining a cylindrical bore; and the lining circumscribing an interior of the bore; whereby the housing is protected by the lining.

4. A valve for directing propellant thrust as set forth in claim 3, further comprising:

the lining being fit by interference in the bore.

5. A valve for directing propellant thrust as set forth in claim 3, further comprising:

the lining being fit by adhesion in the bore.

6. A valve for directing propellant thrust, comprising:

a housing having a cylindrical bore formed therein;

a refractory cylinder wall lining circumscribing an interior of the bore such that the housing is protected by the lining, the refractory lining defining a cylinder symmetrically disposed about a longitudinal axis; and a piston disposed axially relative to the longitudinal axis and configured to slidably move within the cylinder along the longitudinal axis.

7. A valve for directing propellant thrust as set forth in claim 6, further comprising:

the refractory cylinder wall lining being fit by into the bore by means selected from the group consisting of interference fit, shrink fit, and adhesion.

8. A valve for directing propellant thrust as set forth in claim 6, wherein the refractory cylinder wall lining is made from metal of the group consisting of rhenium, tungsten, niobium, tantalum, molybdenum, and alloys thereof.

9. A missile guided by diverted thrust gasses, comprising:

a divert valve having a refractory cylinder wall lining, the refractory cylinder wall lining defining a cylinder symmetrically disposed about a longitudinal axis; and a piston disposed axially relative to the longitudinal axis and configured to slidably move within the cylinder along the longitudinal axis.

10. A missile guided by diverted thrust gasses as set forth in claim 9, wherein the divert valve further comprises:

a housing having a cylindrical bore formed therein; and a rhenium cylinder wall lining circumscribing an interior of the bore such that the housing is protected by the lining, the rhenium lining defining the cylinder symmetrically disposed about a longitudinal axis.

* * * * *